United States Patent [19]

Reuter et al.

[11] 4,262,470

[45] Apr. 21, 1981

[54] PACKAGING SYSTEM WITH CANTILEVERED WEB FEED SYSTEM ACCESSIBLE FOR CHANGING WEB

[75] Inventors: Daniel L. Reuter, Waldorf, Md.; Philip L. Reid, Duncan, S.C.; Charles M. Blackburn, Davidsonville, Md.; Clifton W. Heffner, Charlotte, N.C.

[73] Assignee: Sigma Systems, Inc., Capitol Heights, Md.

[21] Appl. No.: 955,720

[22] Filed: Oct. 30, 1978

[51] Int. Cl.[3] ..... B65B 9/08; B65B 51/30; B65B 41/14

[52] U.S. Cl. ..... 53/202; 53/551

[58] Field of Search ..... 53/552, 551, 550, 389, 53/373, 202, 553, 554

[56] References Cited

U.S. PATENT DOCUMENTS

| | | | |
|---|---|---|---|
| 3,061,989 | 11/1962 | Newell et al. | 53/552 |
| 3,488,914 | 1/1970 | Csernak | 53/551 X |

*Primary Examiner*—Horace M. Culver

*Attorney, Agent, or Firm*—Laurence R. Brown

[57] ABSTRACT

This invention provides a packaging system for processing a web from a roll to fold it, insert a product and to seal it about the product to form the package. All web processing equipment is cantilevered to one side of a panel to permit ready replacement and feeding of a new web roll. Quick changeover features are also included for changing web and package size. The entire drive mechanism for pulling the web through the system is a motor driven reciprocating member grasping and pulling a length of web through the system for each programmed package.

Preferably the web is of a thermoplastic material which can receive and display such products as peanuts, and other food products, hardware, and the like. All mechanisms are in the form of cantilevered members for passing the web through a feed path held stationarily in place on a single panel except for the single reciprocating drive member. Only two other parts move in the system for processing the package, namely, respective longitudinal and transverse sealing mechanisms.

9 Claims, 5 Drawing Figures

PACKAGING SYSTEM WITH CANTILEVERED WEB FEED SYSTEM ACCESSIBLE FOR CHANGING WEB

TECHNICAL FIELD

This invention relates to packaging systems forming a continuous web into a package surrounding an inserted product, and more particularly it relates to such systems with simplified construction, controls and accessibility to change webs.

BACKGROUND ART

Most prior art packaging systems involve complex machinery such as Hopkins U.S. Pat. No. 1,659,143 issued Feb. 14, 1928 and Stroop U.S. Pat. No. 3,054,236 issued Sept. 18, 1962. Some have very complex web roller and feeding mechanisms as shown in Kato U.S. Pat. No. 3,733,596 issued Nov. 20, 1973. Most drive systems depend upon pull roller drives, which causes complex web paths and make the changing of web rolls and the feeding of a new web end through the processing path difficult. Presently marketed packaging systems of the aforementioned types include form-fill-seal packaging systems manufactured and sold by Sigma Systems, Inc. in Capitol Heights, Maryland and by Package Machinery Company, East Longmeadow, Maine. All of these are packaged so that it is very complex to locate web paths and require when changing of web rolls the feeding of the web through complicated machinery paths inside cabinets and through power operated feed rollers that need be mechanized to feed the web thereby introducing danger of injury to an operator. Also control circuits, sequencing and timing operations require complex mechanisms and electric control devices.

It is therefore an object of this invention to correct the foregoing deficiencies of the prior art by simplifying the web feed paths, the mechanisms and the control system.

It is also a problem with complex prior art mechanisms and web feed paths to achieve high operational speeds since the necessary sub-operations are numerous and time consuming. This limits the speed of output production. Thus, another object of the invention is to provide a reliable packaging system capable of high speed operation.

While some prior art systems such as Hanson et al., U.S. Pat. No. 3,988,970 issued Nov. 2, 1976, have produced simple systems for making bags, with accessible cantilevered web rolls so that the web feed paths might be observed and changed more readily, no known complete packaging system for packaging products with a continuous web has heretofore provided a structure with the versatility of efficient changeover of web rolls, feeding of the web end and changeover of package and web size all simultaneously in a complete packaging system.

It is our objective to achieve that as well.

Other features, advantages and objects of the invention will be set forth throughout the following specification, drawing and claims which include for example such features as doubling the package output speed without a corresponding increase of mechanisms or controls, producing very simple controls to thereby reduce the time and equipment required for completion of a packaged product, providing an entire packaging system with all web processing devices cantilevered on one side of a panel, and feeding the web out package by package, asynchronously if required, in response to a reciprocating web advance mechanism.

DISCLOSURE OF INVENTION

The packaging system afforded by this invention achieves the foregoing objectives and advantages in improving the state of the art by means of a very simple set of cantilevered members mounted on one side of a single panel for processing web preferably theremoplastic from a roll to form it into a package about an inserted product that may be a known number of pieces of hardware, an apple, or like products. A reciprocating motor driven mechanism pivoting on an axis comprises one cantilevered member that processes the web and consists of the sole motivation means for advancing the web through the system a length at a time for each packaging cycle.

The web, which may be pre-printed if desired, is folded over a tube and formed into a tube to receive a product thereinto and is sealed transversely on both sides of the product to complete a package. Thus, longitudinal and transverse sealing members respectively are located in the web path and are timed to operate respectively while the web is stationary and in motion by operation of the reciprocating mechanism which advances the web and retraces.

BEST MODE FOR CARRYING OUT THE INVENTION

Figure 2:
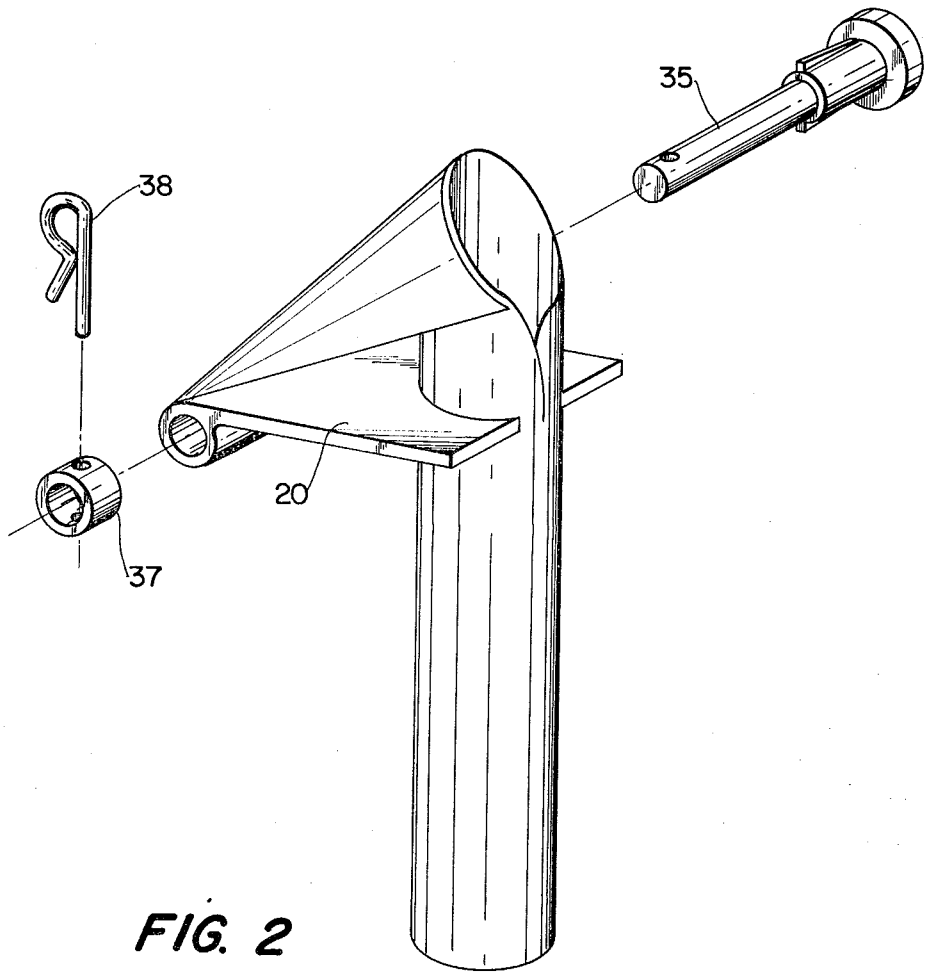
FIG. 2 is a perspective exploded view of a replaceably web folding and product insert tube construction afforded by this invention.
Figure 1:
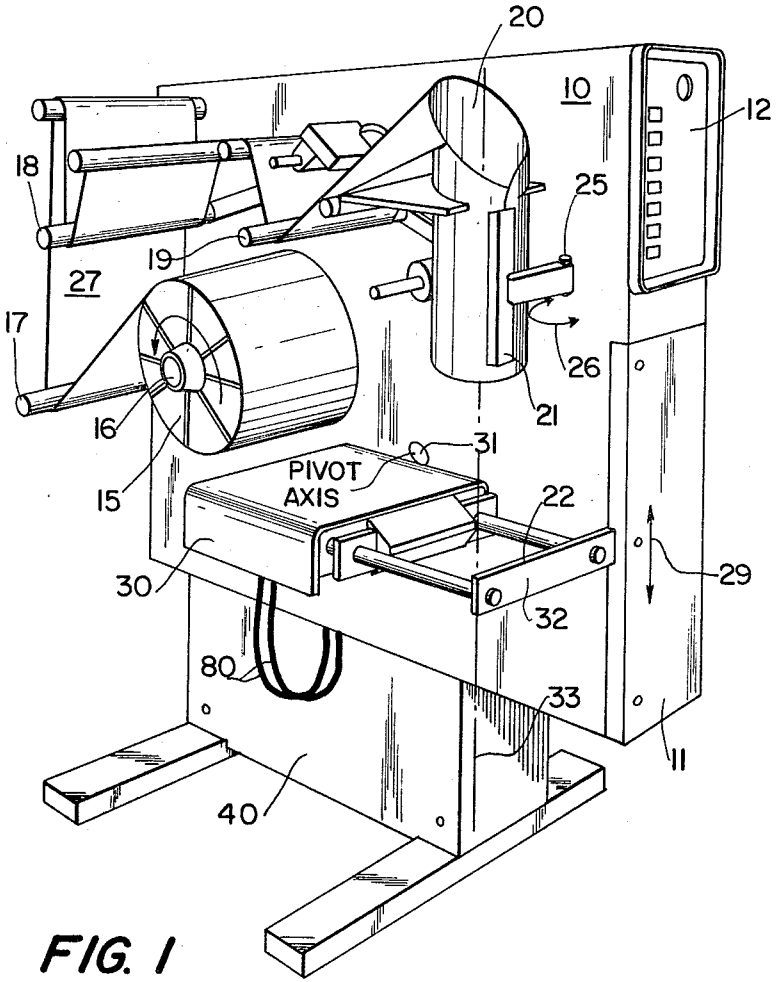
FIG. 1 is a perspective sketch of the front panel assembly of a packaging system as afforded by this invention.

As may be seen from FIGS. 1 and 2, the packaging systems has all elements processing the web accessible from one side of the panel 10 which is on one side of a cabinet assembly 11 about one half meter thick, which houses all the drive mechanism, mechanical mounts and control devices operated by the control panel 12.

It can be seen that when a web roll 15 is depleted of its stock of web, the spool is slipped off the cantilevered roller 16 and a new roll can be inserted and fed through rollers 17, 18, 19, etc. and over the folding and feeding tube assembly 20 so that the longitudinal sealing element 21 can form the web into a tubing about the tube assembly 20 that is thus adopted to receive a product such as peanuts, bolts, etc.

The sealing element 21 is heated so that it can remain in contact with a thermoplastic web at rest and seal it but not burn it in a preferred embodiment. Then the web is fed downwardly into the grasper, transverse sealer and slicer mechanism 22, better described in my copending application Ser. No. 955,752 filed the same day as this present application. As the web moves downwardly, the sealing element 21 is pivoted away from the web about pin 25 as indicated by arrow 26. Thus, the sealing element 21 also when clamped against the web and tubing 20 serves as a brake to hold the web 27 and prevent backward movement toward roll 15.

Forward movement of the web is controlled solely by the pivoted carriage assembly 30, which pivots about the pivot axis 31 in the manner later described in connection with FIG. 3.

In general operation the carriage 30 pivots to move the grasper jaw 32 upwardly along the vertical axis path of the package tubing 33 thereby to close and transversely seal the tubing on both sides of the product in sequential operations for example to form the package. After the jaw 32 is closed to grasp the web, then the carriage 30 is pivoted to move jaw 32 downwardly before releasing the web for another bite in reciprocating action indicated by arrow 29. This advances the web package by package in a cyclic manner that can be programmed asynchronously as later described.

As seen in FIG. 2, the forming and filling tube assembly 20 can be simply replaced for different web widths and thus different package sizes by slipping on and off a quick change cantilevered pin 35 registering in the aperture 36 for receiving retainer ring 37 and cotter key 38.

Figure 4:
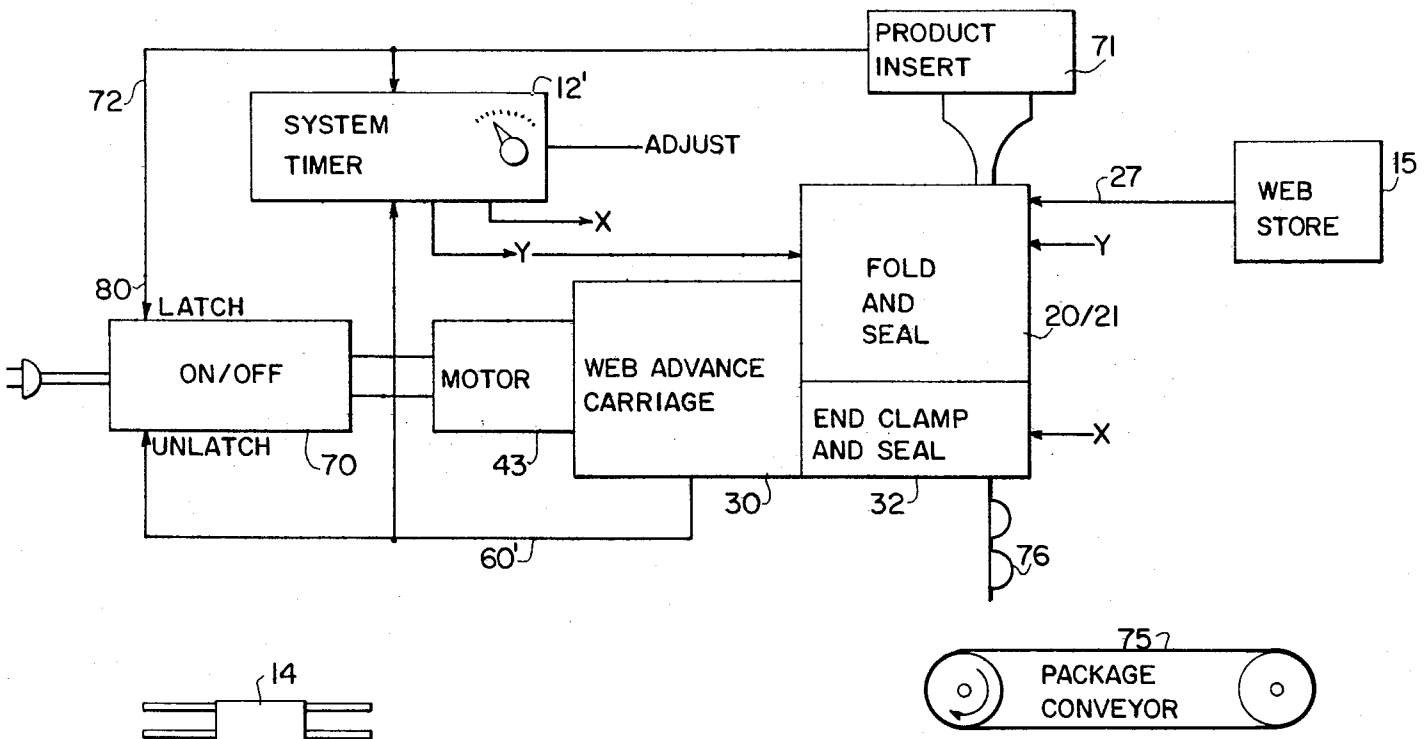
FIG. 4 is a block diagram control system diagram illustrating the timing and sequencing of operation steps in the packaging system of this invention.

Also it may be seen in FIG. 4, for example, that a package conveyor may be located under the slicer jaw 32 to receive packages severed from the web and transport them in either of two directions, namely parallel to panel 10 or normal thereto. Because of the action of pivot carriage 30 at the limit of the upward movement the web tubing is transversely closed so that products need not fall far through entry tube 20. Also the transverse sealing takes place as the web moves downwardly to the bottom limit of movement, where a package can be severed from the web so that it has little distance to drop into a conveyor mounted for example in front of panel 40.

The control mode of this system is most simple as seen in FIG. 4, primarily because of the simple pivot carriage assembly for advancing the web as hereinbefore described, and the fact that the motor drive therefor can be easily controlled by simple control circuitry. It is clear that the movable mechanical parts are minimized and those present are simple comprising for example the web rollers 17, 18, 19 which have cylindrical shells journalled on cantilevered bearing pins attached to panel 10 (FIG. 1).

The on-off motor controls 70 may comprise a simple latching relay for example that is controlled from either the switch 60 feedback path 60', the presence of a product ready to be packed at product insert means 71 by way of lead 72 or by control circuitry operable from the console panel 12 for establishing various time sequences to cover different packaging requirements, such as auxiliary printing and to time the various simple functions of the hereinbefore described system of FIG. 1.

The package conveyor 75 is shown for receiving packages 76 formed from the web 27 as they are sliced off the web by the end seal mechanism 32 and released at the bottom of the carriage 30 pivot stroke by opening the clamping jaws.

In a typical asynchronous operation sequence, a product arrives at product station 71 or is counted out as a specified number of bolts, and thus triggers a latch pulse at 80 turning on motor 43 for an operation cycle unlatched by the end of cycle switch at line 60'.

Figure 3:
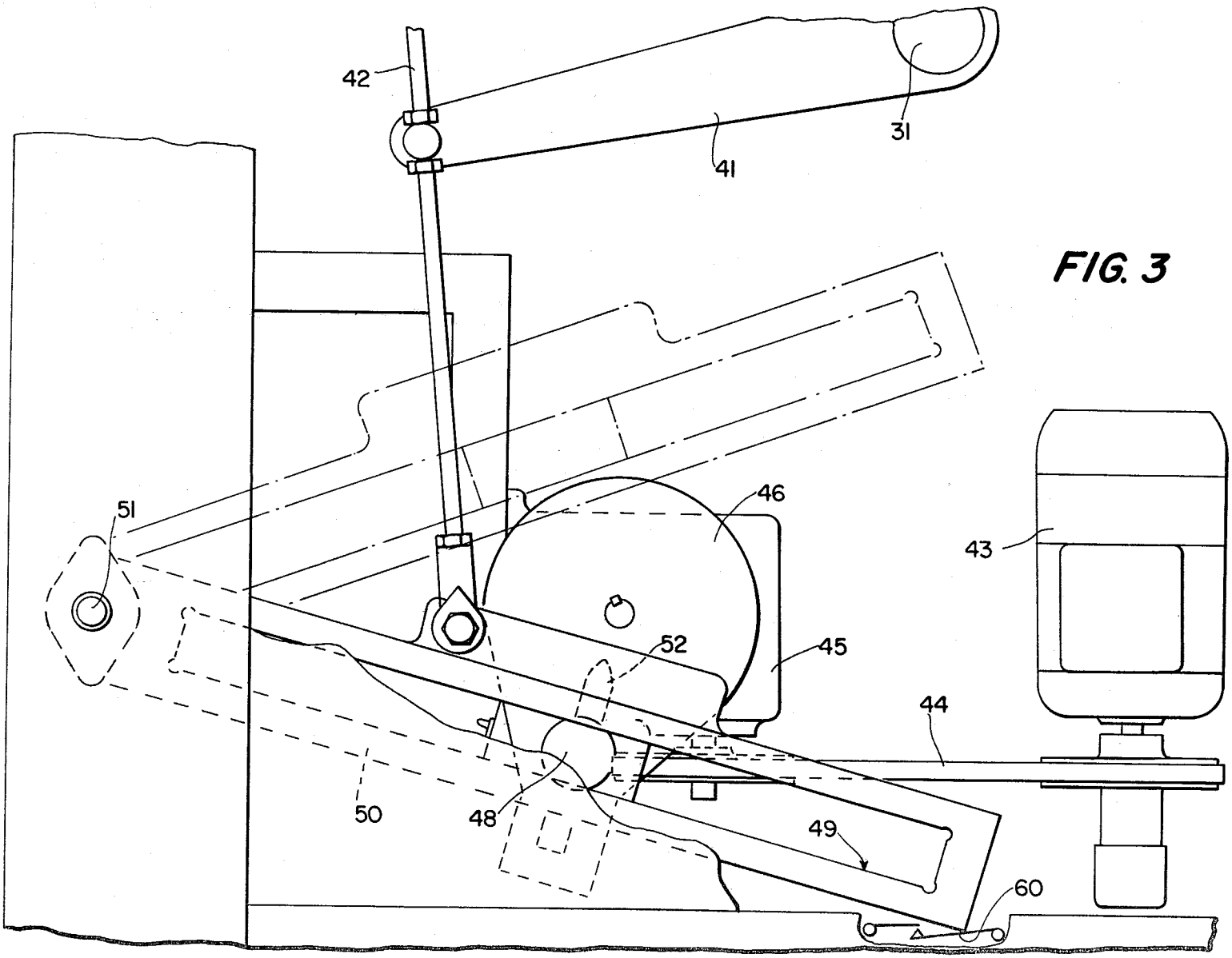
FIG. 3 is an elevation view of a packaging machine drive assembly as afforded by this invention.

The carriage 30 pivot axis 31 is referenced in FIG. 3 to shown the means inside cabinet 11 for moving the web. Thus pivot arm 41 is moved back and forth by threaded connecting link 42 after adjustment by locking nuts for the appropriate position of carriage 30 at the uppermost end of the reciprocation.

Link 42 is reciprocated by motor drive means 43 through belt 44 and gear box 45 to operate at proper highest package cycle speed in the order of 60 packages per minute. Thus, the flywheel 46 will rotate in one second to produce one complete reciprocation of link 42 and therefore carriage 30, by means of cam pin 48 riding in slot 49 to pivot arm 50 about pivot point 51.

The stroke length, identified by the showing of pivot arm 50 in phantom at the top of the stroke and in full lines at the bottom, may be changed by locking the cam pin 48 at different positions in the slot 52 in flywheel 46. This can be used for example to change package length. For a long package therefore the carriage 30 will pull a longer length of web from roll 15 than for a shorter package with a shorter reciprocation stroke. Switch 60 may be used for control purposes to denote end of cycle or to put the operation into a cyclic mode by programming the next cycle as soon as a prior one is completed.

Other timing synchronizing signals are derived from the timer 12' which processes both the product ready and the cycle completion input pulses for deriving other timed sync signals such as X for the transverse (abscisson) sealing, grasping and cutting operation of end clamp X and Y for the longitudinal (ordinate) sealing operation of sealing device 21. Thus, in cabinet 11 (FIG. 1) a solenoid or air cylinder in pivoted carriage 30 will operate jaw 32 in response to the X sync signal, and for this purpose (FIG. 1) air tubes 88 are shown.

In general seal 21 is closed as the carriage 30 pivots upwardly and whenever awaiting a product signal, and is opened to permit web movement on the downward stroke of carriage 30.

The clamping jaw 32 is closed just before the downward stroke, and released before the upward stroke. If desired a timer in the control system can change the package length between reasonable limits by using a range from only part of the entire downward stroke to pull the web through the system for forming a further package assembly. Also by proper controls cutting of packages from the continuous can be limited to produce a sequence of two or more joined packages, and possibly two side by side packages can be formed or two serial packages in one stroke without departing from the concepts of this invention.

Figure 5:
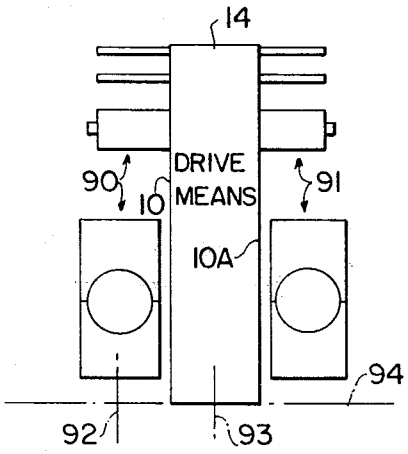
FIG. 5 is a sketch of a twin web processing embodiment afforded by the invention having a common drive mechanism.

Because of the simple mechanisms and controls and the timing of the sealing, high speed operation is possible in the order of 60 strokes per minute. As shown in FIG. 5, the mechanism layout also is very advantageous for operating at 120 package strokes per minute with the same drive mechanism, by mounting the cantilevered web processing assemblies 90, 91 on opposite panel sides 10 and 10A of the cabinet assembly 14. Two different products may thus be packaged simultaneously for conveying out in separate conveyors on axes 92, 93 or mixed for a single conveyor on axis 94.

INDUSTRIAL APPLICABILITY

A very simple packaging machine and mechanism is afforded that can therefore work at high speed producing in the order of 60 to 120 packages a minute from a web of thermoplastic material that is folded over and sealed around a product such as peanuts or bolts. Easy web roll changeover features are provided together with simplified changeover for different package widths and lengths. The system can be asynchronously operated on command for a packaging cycle when a product is ready for packaging as for example when a counter puts a dozen bolts in a batch and delivers the batch for packaging.

We claim:

1. A packaging system for making packages about a product from a continuous web feeding thereinto from a roll, said system including a package forming mechanism having a panel, with all movable members for feeding the web to form packages including a set of rollers cantilevered to one side of said panel and with all movable members rotatable about axes perpendicular thereto, and a single advancing mechanism for pulling the web from the roll through the package forming mechanism to form a package of predetermined length a pivoted carriage extending from a pivot shaft on said one side of the panel to reciprocate by rotation of said pivot shaft from a pivoting mechanism inside said panel thereby moving said carriage over a pivot stroke and including web clamping means on said carriage operable during a predetermined stroke length to grasp the web intermittently and pull said length of the web through said package forming mechanism.

2. The system defined in claim 1 including a drive motor coupled to pivot said carriage by a reciprocating mechanism.

3. The system defined in claim 2 including control means for operating the motor over a single reciprocation cycle.

4. The system defined in claim 3 including means for adjusting the length of said reciprocation thereby to adjust the length of web advanced for establishing a package length.

5. The system defined in claim 1 wherein a web folding, sealing and product inserting tube is positioned on the panel with said cantilevered rollers for processing the web to form a tubing for receiving a product thereinside.

6. A system as defined in claim 5 wherein means is provided for forming a package from a single web including heat sealing means for sealing the web longitudinally into a tubing pivots into engagement with said tube about an axis parallel to said panel.

7. The system defined in claim 1 wherein the tube is retained removably on a pin assembly cantilevered from said panel to permit a quick change for different size packages.

8. A system as defined in claim 1 wherein the pivoting mechanism inside the panel comprises a flywheel periodically rotatable, a cam pin adjustably mounted along a radius of said flywheel, and a cam slot engaging said pin and pivotable about a reciprocate cycle coupled to pivot said carriage about a pivot arc length dependent upon the radially adjustable position of said cam pin.

9. A packaging system for processing a package from a web, comprising in combination, a source of web supply, a package forming mechanism, a plurality of rollers for conveying said web from said source of web supply to said package forming mechanism, a single panel frame member, and cantilever means for rotatably mounting all said rollers extended by only one cantilevered end perpendicular to said panel whereby the web is accessible for replacement or service without demounting any frame members wherein a common mechanism is contained in a central compartment for operating two duplicate systems as defined located on and cantilevered from opposite sides of the compartment.

* * * * *